US007725966B2

(12) United States Patent
Prater et al.

(10) Patent No.: US 7,725,966 B2
(45) Date of Patent: Jun. 1, 2010

(54) TEMPERATURE CONTROLLED STROLLER BLANKET

(75) Inventors: James B. Prater, Anna, IL (US); Christel L. Prater, Anna, IL (US)

(73) Assignee: The Jimmy, Inc., Anna, IL (US)

( * ) Notice: Subject to any disclaimer, the term of this patent is extended or adjusted under 35 U.S.C. 154(b) by 0 days.

(21) Appl. No.: 11/958,865

(22) Filed: Dec. 18, 2007

(65) Prior Publication Data

US 2008/0141458 A1 Jun. 19, 2008

Related U.S. Application Data

(60) Provisional application No. 60/870,761, filed on Dec. 19, 2006.

(51) Int. Cl.
*A47G 9/02* (2006.01)

(52) U.S. Cl. ..... 5/484; 5/485; 5/500; 5/655

(58) Field of Classification Search ..... 5/2, 5/6, 11, 655, 947, 484–485, 500–502
See application file for complete search history.

(56) References Cited

U.S. PATENT DOCUMENTS 2,596,547 A * 5/1952 Winifred ..... 5/502
4,839,934 A 6/1989 Rojas
5,168,590 A 12/1992 O'Sullivan
5,335,677 A * 8/1994 Busch ..... 128/852
D361,686 S 8/1995 Stearns
5,781,946 A 7/1998 McEntire et al.
5,833,309 A 11/1998 Schmitz
6,243,896 B1 6/2001 Osuna et al.
6,274,520 B1 * 8/2001 Cordell ..... 442/381
6,394,543 B1 * 5/2002 Dunne et al. ..... 297/219.12
6,523,354 B1 2/2003 Tolbert
6,684,422 B2 2/2004 LeFevre et al.
6,725,478 B2 4/2004 Birch
2006/0213156 A1 9/2006 Nilfuroshan

* cited by examiner

*Primary Examiner*—Fredrick Conley
(74) *Attorney, Agent, or Firm*—Levenfeld Pearlstein, LLC

(57) ABSTRACT

A temperature controlled stroller blanket for controlling the ambient temperature around a child in a stroller is disclosed. The blanket is configured to be placed beneath the child within the stroller compartment. The blanket is constructed with a plurality of sealable pockets. The pockets are sized to receive and hold temperature packs for producing heat or extracting heat (cooling). The blanket also preferably includes a plurality of slits configured to permit passage of the straps of the stroller harness system to secure the child in the stroller. The temperature packs act to warm or cool the ambient air around the child, creating a comfortable environment within the stroller compartment. Once the packs expire, they may be removed and recharged or replaced.

14 Claims, 3 Drawing Sheets

TEMPERATURE CONTROLLED STROLLER BLANKET

BACKGROUND OF THE INVENTION

The present invention relates to a blanket. More particularly, the present invention concerns a temperature controlled stroller blanket having a plurality of pockets and configured to control the ambient temperature around a child.

Young children, especially infants, are particularly sensitive to temperature extremes. Maintaining the proper body temperature of a child, therefore, is an important part of the child's health and safety.

Children often are transported outdoors in strollers. Many such strollers are designed to maximize the comfort and safety of the child. For example, to protect the child from the elements—sun, rain, wind, snow, etc.—strollers often include a semi-enclosed, or in some cases fully-enclosed, interior compartment within which the child is contained. The compartment may be surrounded by a retractable canopy and may include a convertible seating device to allow the child to sit in multiple upright or reclined positions. Such strollers also typically include a harness system to secure the child in the stroller.

While it is advantageous to protect a child from the elements, a semi-enclosed, or fully-enclosed, stroller compartment creates an environment in which the ambient temperature within the compartment may vary dramatically based on the exterior conditions. For example, on a hot summer day, it is desirable to enclose the child within the stroller compartment to protect the child from direct exposure to the sun. However, the temperature within the enclosed stroller compartment may increase to levels unsuitable for the child.

Similarly, on a cold winter day, it is desirable to enclose the child within the stroller compartment to protect the child from cold temperatures and the effects of windchill. However, even when the child is well insulated with multiple layers of clothing, the temperature within the enclosed stroller compartment may decrease to levels unsuitable for the child.

Therefore, it would be advantageous to provide a device to control the ambient temperature within a stroller compartment. Preferably, such a device comprises a readily portable stroller blanket configured to provide heating or cooling of the air within the stroller compartment without the need for complex thermoelectric heating and cooling units requiring a power source.

The prior art has developed numerous types of heating and cooling blankets for highly specialized purposes, however no such prior art blankets are designed to be used in strollers. For example, U.S. Pat. No. 6,523,354 to Tolbert discloses a cooling blanket designed to be wrapped around a person to reduce the person's body temperature, primarily for medical purposes, such as fever reduction and treatment of night sweats. The device uses thermoelectric cooling units disposed within a blanket. However, the Tolbert device is not specifically designed for use in strollers and would be inappropriate for use on children in hot, summer weather.

Published U.S. Pat. Application US2006/0213156 to Nilfuroshan discloses a blanket designed to be placed on animals, particularly horses, in order to deliver a targeted temperature altering regimen to a specific part of the animal's body. Such device is not specifically designed to be used for humans and has no application for use in strollers.

Accordingly, there is a need for a temperature controlled stroller blanket configured control the ambient temperature around a child in a stroller compartment. Desirably, the stroller blanket includes a plurality of integrated pockets configured to hold hot and cold packs. More desirably, the stroller blanket includes a plurality of slits configured to permit passage of straps from the stroller harness system through the stroller blanket so the child may be secured in the stroller. Most desirably, the stroller blanket is easily constructed, readily portable, comfortable and simple to use, and does not require any external power source.

BRIEF SUMMARY OF THE INVENTION

The present invention relates to a temperature controlled stroller blanket having a plurality of pockets configured to hold hot and cold packs for controlling the ambient temperature around a child in a stroller compartment.

In the preferred embodiment, the temperature controlled stroller blanket of the present invention is configured to be placed beneath a child within the compartment of a stroller. The top side of the blanket preferably is constructed of a soft, plush, comfortable material, such as fleece, designed to be in contact with the child. The bottom side of the blanket preferably is designed of a waterproof material, such as vinyl. The blanket preferably is formed in a quilted manner with an insulating batting disposed between the top side and the bottom side, and piping attached around the perimeter.

The bottom side of the blanket is constructed with a plurality of sealable pockets formed to cover substantially all of the area of the bottom side. The pockets include hook-and-loop (i.e., Velcro®) type closures for sealing (and resealing) the pockets in the preferred embodiment.

The pockets are sized to receive and hold hot and cold packs of the type commonly used to warm or cool food, or to treat injuries, for example. Such packs may be of the reusable variety (heated in the microwave and/or cooled in the freezer) or may be one-time use packets. The pockets preferably are formed from the same waterproof material as the bottom side of the blanket and are lined on one side with a slightly absorptive, insulating material to help absorb any condensation created by the packs and helps insulate the packs.

The blanket also preferably includes a plurality of slits disposed about the area of the blanket. The slits extend through the blanket, from the top of the blanket to the bottom of the blanket. The slits are configured to permit passage of the straps of the stroller harness system through the blanket to secure the child in the stroller with the blanket disposed beneath the child.

In use, heated or cooled packs are placed in the pockets on the bottom side of the blanket and the pockets are sealed. The blanket then is placed along the bottom of the stroller compartment (generally lying flat along the stroller seat), and beneath the child. The stroller harness straps are passed through the slits and a child is secured in the stroller. The heated or cooled packs act to warm or cool the air around the child, creating a comfortable environment within the stroller compartment. Once the packs expire, they may be removed and recharged, or replaced.

These and other features and advantages of the present invention will be apparent from the following detailed description and drawings in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
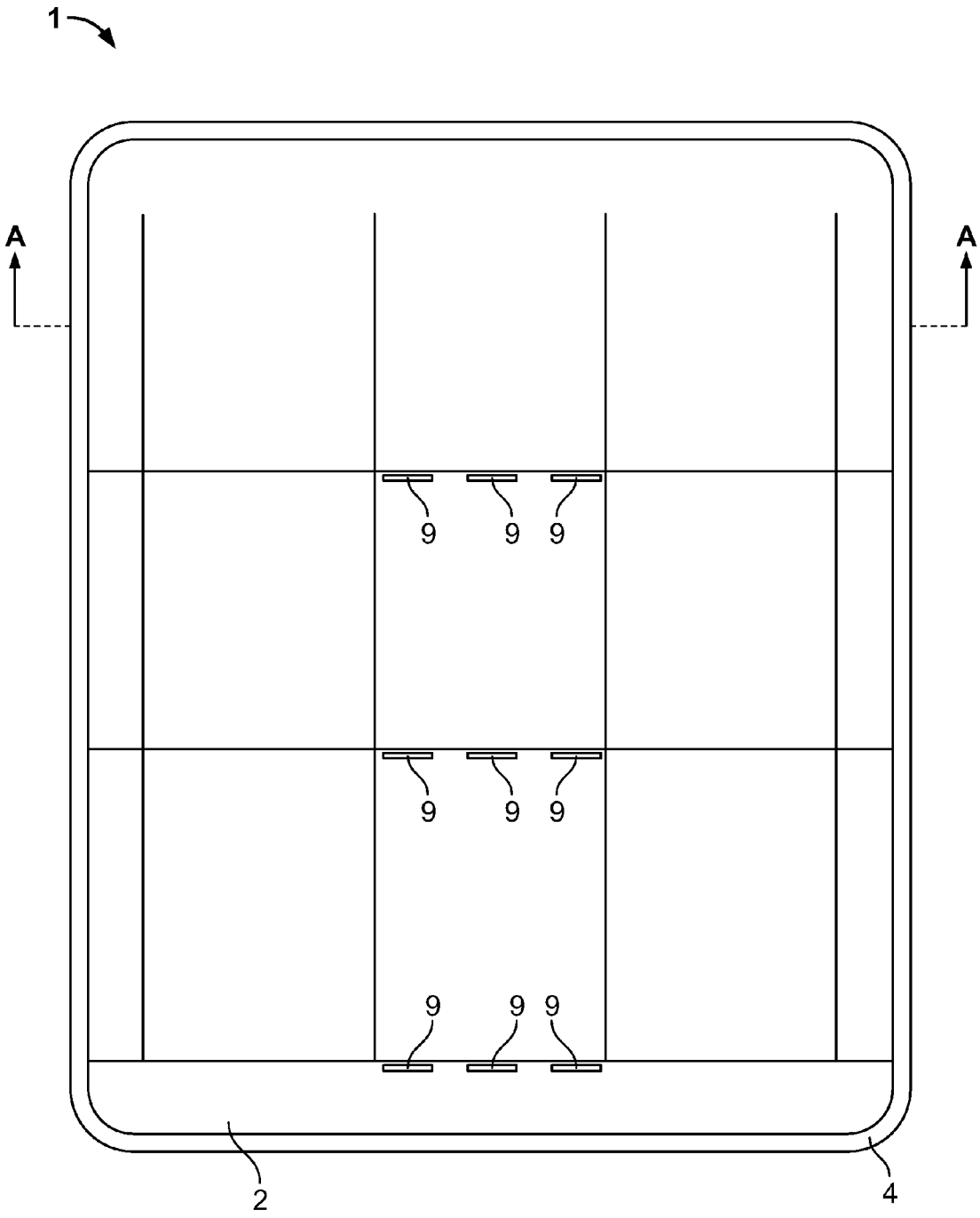
FIG. 1 is a perspective view of top side of the temperature controlled stroller blanket of the present invention.

While the present invention is susceptible of embodiment in various forms, there are shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent and Trademark Office, and does not imply, nor should be inferred to limit the subject matter disclosed herein.

The present invention relates to a temperature controlled stroller blanket having a plurality of pockets configured to hold hot and cold packs for controlling the ambient temperature around a child in a stroller compartment. In the preferred embodiment, the temperature controlled stroller blanket of the present invention is configured to be placed beneath a child on the seat of the stroller.

Figure 2:
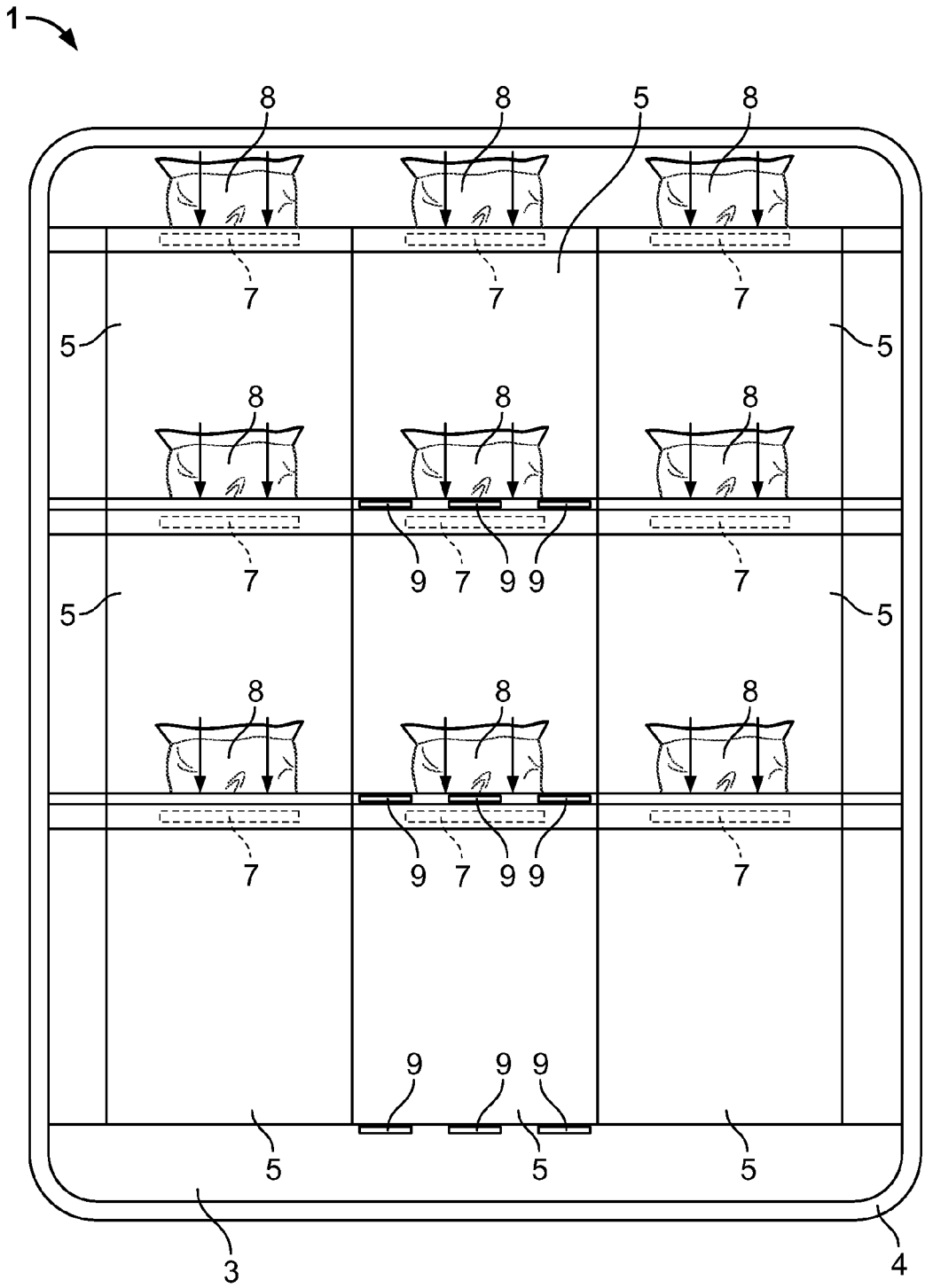
FIG. 2 is a perspective view of the bottom side of the temperature controlled stroller blanket of the present invention, with temperature packs partially inserted therein; and, FIG. 3 is an enlarged, fragmentary cross sectional view of the temperature controlled stroller blanket of the present invention as shown in FIG. 1, taken along the line A-A.

As shown in FIGS. 1 and 2, blanket 1 in the preferred embodiment of the present invention is constructed in a generally rectangular shape with dimensions appropriate to the typical size of a stroller compartment. In one embodiment, blanket 1 measures approximately 3 feet long by 2 feet wide. However, it will be appreciated that the size of blanket 1 may vary without departing from the scope and spirit of the present invention.

Figure 3:
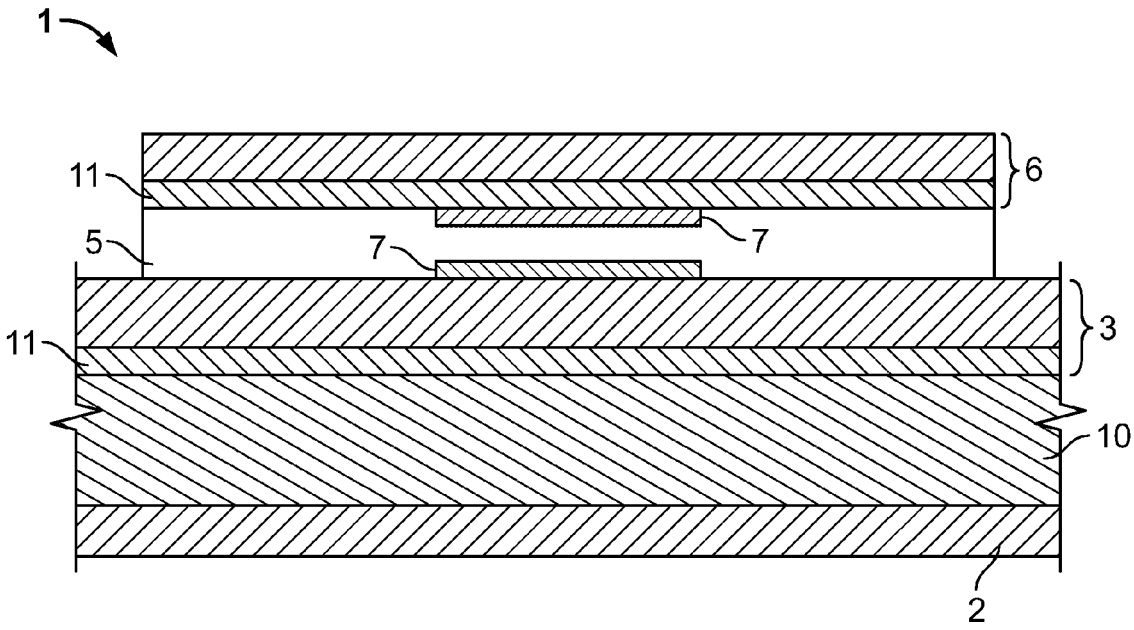

Blanket 1 preferably is formed in a quilted manner using techniques known to those skilled in the art. That is, blanket 1 comprises a top side 2 and a bottom side 3 (shown in FIG. 2) quilted (or stitched) together with an insulating batting 10 (as shown in FIG. 3) disposed therebetween. Batting 10 may be composed of many types batting materials as are known to those skilled in the art, such as cotton or polyester. Batting 10 helps insulate the child from the temperature packs disposed on the bottom side 3 of blanket 1 (as further discussed below).

As shown in FIG. 1, top side 2 of blanket 1 is designed to be in contact with the child when the child is located in the stroller. Thus, it is desirable that top side 2 be constructed of a soft, plush, comfortable material, such as fleece in the preferred embodiment, that helps provide a pleasant and enjoyable environment for the child. To an extent, the fleece material of top side 2 also helps to insulate the child from the temperature packs disposed on the bottom side 3 of blanket 1.

For aesthetic purposes, blanket 1 may also include piping 4, disposed about the perimeter of blanket 1. Moreover, the outer surface of top side 2 may be printed with whimsical decorations or artwork to stimulate and entertain the child.

As shown in FIG. 2, bottom side 3 of blanket 1 is constructed with a plurality of sealable pockets 5 formed on bottom side 3 to cover substantially all of the area of bottom side 3. Preferably, bottom side 3 is constructed of a waterproof material, such as vinyl in the preferred embodiment. More preferably, the vinyl material used for bottom side 3 is backed with a slightly absorptive, insulating material 11 (as shown in FIG. 3) such as a thin layer of polyester or cotton. Like top side 2, the outer surface of bottom side 3 may be printed with whimsical decorations or artwork to stimulate the child.

Pockets 5 are formed by affixing pocket walls 6 (as shown in FIG. 3) to the outer surface of bottom side 3. Preferably, pocket walls 6 are formed of the same material used for bottom side 3 (a waterproof vinyl backed with a slightly absorptive, insulating material 11, such as a thin layer of polyester or cotton).

In the preferred embodiment, pocket walls 6 are affixed to bottom side 3 by sewing the sides and bottoms of pocket walls 6 to bottom side 3 to form pockets 5. The tops of pocket walls 6 are not sewn to bottom side 3 in order to create openings to access pockets 5.

As shown in FIGS. 2 and 3, pockets 5 are constructed to be sealable. In the preferred embodiment, pockets 5 include hook-and-loop (i.e., Velcro®)-type closures 7 for sealing (and resealing) pockets 5. Hook-and-loop-type closures 7 are well known to those skilled in the art and comprise a hook material, in this case mounted to the outer surface of bottom side 3, and a loop material, in this case mounted to the inner surface of pocket walls 6. The hook material and the loop material are configured to releasably engage one another, thereby sealing pockets 5.

Preferably, pockets 5 are sized and disposed such that pockets 5 cover substantially all of the area of bottom side 3. In this manner, the heating and/or cooling effect of temperature packs 8 (as further discussed below) can be distributed across substantially all of the area of blanket 1.

As shown in FIG. 2, pockets 5 are disposed adjacent (or in close proximity) to one another and are preferably aligned in rows and columns. Moreover, pockets 5 are sized to receive and hold temperature packs 8 (shown in FIG. 2) of the type commonly used to warm or cool food, or to treat injuries, for example. Temperature packs 8 may be of the reusable variety (heated in the microwave and/or cooled in the freezer) or may be designed one-time use. Temperature packs 8 are well known in the art.

Since the interior of each pocket 5 is comprised of a portion of the outer surface of bottom side 3 along with a portion of the inner surface of pocket wall 6, and since the inner surface of pocket wall 6 is backed with a slightly absorptive, insulating material 11 (such as a thin layer of polyester or cotton), condensation created by temperature packs 8 placed in pockets 5 may be advantageously absorbed by insulating material 11. Additionally, insulating material 11 of bottom side 3 and pocket walls 6 advantageously acts to insulate temperature packs 8 to prolong their effectiveness.

As shown in FIGS. 1 and 2, blanket 1 in the preferred embodiment of the present invention further includes a plurality of slits 9 disposed about the area of blanket 1. Slits 9 extend through blanket 1, from top side 2 to bottom side 3, in order to create openings in blanket 1. Slits 9 are configured to permit passage of the straps of the stroller harness system (not shown) through blanket 1 in order to secure a child in the stroller with blanket 1 disposed beneath the child. It will be appreciated that the size and location of slits 9 may vary, without departing from the scope of this invention, depending on the particular stroller harness strap design and layout.

In use, temperature packs 8 are activated to provide the desired heating or cooling effect and placed into pockets 5 of blanket 1 in the direction of the arrows as shown in FIG. 2. Pockets 5 are then sealed using closures 7 and blanket 1 is placed along the bottom of a stroller compartment (generally lying flat along the stroller seat). The stroller harness straps are passed through slits 9 and the child is secured in the stroller disposed against top surface 2 of blanket 1. The stroller compartment may then be partially or fully enclosed in order to create a controlled temperature environment within the stroller compartment.

Although FIG. 2 depicts temperature packs 8 being inserted into each of pockets 5 of blanket 1, it will be appreciated that temperature packs 8 need not be inserted in all of pockets 5 during all uses of blanket 1. That is, depending on the relative temperatures inside and outside the stroller compartment, it may not be necessary to place temperature packs 8 into all of pockets 5. When only a modest heating or cooling effect is desired, fewer temperature packs 8 may be used. However, when a maximum heating or cooling effect is desired, the maximum amount of temperature packs 8 may be used.

In the summer, when temperature packs 8 produce a cooling effect, temperature packs 8 act to cool the ambient air around the child, providing a pleasant, comfortable environment within the stroller compartment. In the winter, when temperature packs 8 produce a heating effect, temperature packs 8 act to warm the ambient air around the child, again providing a pleasant, comfortable environment within the stroller compartment. Once temperature packs 8 expire, they may be removed and recharged or replaced.

Since the child is separated from temperature packs 8 by top side 2, the interior batting and bottom side 3 of blanket 1, the child is never in direct contact with temperature packs 8. Moreover, the radiated heating or cooling effect of temperature packs 8 is advantageously dispersed as it travels through bottom side 3, the interior batting and top side 2 of blanket 1.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. A temperature controlled stroller blanket comprising:

a top side;

a bottom side, the bottom side comprising a layer of waterproof material backed with a layer of water-absorbent material such that the layer of water-absorbent material is integral with and affixed to the layer of waterproof material;

an insulating batting disposed between the top side and the bottom side; and a plurality of pockets formed on the bottom side, the pockets each having a pocket wall connected to the bottom side to form the pocket, the pocket wall having a water-absorbent inner surface and a waterproof outer surface, such that each pocket comprises an interior area defined by the water-absorbent inner surface of the pocket wall and a portion of the waterproof material of the bottom side, wherein the plurality of pockets are disposed about substantially all of the bottom side.

2. The temperature controlled stroller blanket of claim 1 wherein the waterproof outer surface of the pocket wall comprises vinyl.

3. The temperature controlled stroller blanket of claim 1 wherein the plurality of pockets are sealable.

4. The temperature controlled stroller blanket of claim 1 wherein the plurality of pockets are resealable.

5. The temperature controlled stroller blanket of claim 4 wherein the plurality of pockets further comprise a hook-and-loop type closure.

6. The temperature controlled stroller blanket of claim 1 further comprising a plurality of slits formed in the top side and the bottom side, and extending between the top side and the bottom side.

7. The temperature controlled stroller blanket of claim 1 wherein the plurality of pockets are configured to store a temperature pack.

8. The temperature controlled stroller blanket of claim 1 further comprising at least one temperature pack disposed in at least one of the plurality of pockets.

9. The temperature controlled stroller blanket of claim 1 wherein the waterproof material of the bottom side comprises vinyl.

10. The temperature controlled stroller blanket of claim 1 wherein the insulating batting is comprised of cotton.

11. The temperature controlled stroller blanket of claim 1 wherein the insulating batting is comprised of polyester.

12. The temperature controlled stroller blanket of claim 1 wherein the top side is comprised of fleece.

13. The temperature controlled stroller blanket of claim 1 wherein the top side and the bottom side are quilted together.

14. The temperature controlled stroller blanket of claim 13 further comprising a piping disposed about a perimeter of the blanket.

* * * * *